US011628497B2

(12) United States Patent
Ballard et al.

(10) Patent No.: US 11,628,497 B2
(45) Date of Patent: Apr. 18, 2023

(54) METHOD OF METAL FOAM EXTRUSION AND ARTICLES MANUFACTURED THEREFROM

(71) Applicant: GM Global Technology Operations LLC, Detroit, MI (US)

(72) Inventors: Adam R. Ballard, Chesterfield, MI (US); Joseph M. Polewarczyk, Lake Orion, MI (US); Joshua L. Solomon, Berkley, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 198 days.

(21) Appl. No.: 17/060,637

(22) Filed: Oct. 1, 2020

(65) Prior Publication Data

US 2022/0105565 A1 Apr. 7, 2022

(51) Int. Cl.

| | |
|---|---|
| ***B22F 7/00*** | (2006.01) |
| ***B21C 23/08*** | (2006.01) |
| ***B22F 3/22*** | (2006.01) |

(52) U.S. Cl.

CPC ..... *B22F 7/006* (2013.01); *B21C 23/085* (2013.01); *B22F 3/225* (2013.01); *B22F 2301/052* (2013.01)

(58) Field of Classification Search

None

See application file for complete search history.

(56) References Cited

U.S. PATENT DOCUMENTS 2,051,688 A * 8/1936 Dunsheath ..... B21C 23/30 72/262

3,087,807 A * 4/1963 Allen ..... B22F 3/1125 420/528

FOREIGN PATENT DOCUMENTS

EP 2289641 A1 * 3/2011 ..... B21C 23/22

* cited by examiner

*Primary Examiner* — Daniel J. Schleis

(74) *Attorney, Agent, or Firm* — Cantor Colburn LLP

(57) ABSTRACT

A method for manufacturing a foam in a conduit comprises extruding a metal conduit. A metal foam powder is injected into a cavity of the metal conduit. The metal foam powder is activated to form a metal foam in the cavity of the metal conduit. A device for producing a foamed metal comprises an extruder that comprises one or more screws for extruding a metal through a die to form a conduit. The die comprises a plurality of ports for injecting a metal foam powder into a central hollow cavity or a wall cavity of the conduit. The device comprises a pressurizing section for increasing pressure on the metal foam powder and a thermal section for increasing the temperature of the metal foam powder to facilitate its expansion into a metal foam.

15 Claims, 3 Drawing Sheets

METHOD OF METAL FOAM EXTRUSION AND ARTICLES MANUFACTURED THEREFROM

BACKGROUND

This disclosure relates to a method of metal foam extrusion and articles manufactured therefrom. In particular, this disclosure relates to a method of extruding metal foams inside of a conduit or as part of the walls of the conduit.

Foamed metals are often used to produce reinforced parts for vehicles that transport personnel or goods. Such vehicles include automobiles, bicycles and motorcycles, locomotives, aircraft, ships and boats, or the like. This reinforcing allows for greater energy absorption and consequently a reduction in damage to the vehicle and its occupants.

It is desirable to improve metal foaming processes to make the processes more efficient and less expensive while simultaneously improving the impact absorption capabilities of the parts used in vehicles.

SUMMARY

In an embodiment, a method for manufacturing a foam in a conduit comprises extruding a metal conduit. A metal foam powder is injected into a cavity of the metal conduit. The metal foam powder is activated to form a metal foam in the cavity of the metal conduit.

In another embodiment, a cavity is a central hollow cavity concentrically located with respect to a conduit wall(s).

In yet another embodiment, the cavity is a central hollow cavity eccentrically located with respect to a conduit wall(s).

In yet another embodiment, the cavity is wall cavity located between an inner wall and an outer wall of the metal conduit.

In yet another embodiment, the metal conduit and the metal foam comprise the same metal.

In yet another embodiment, the metal conduit comprises a different metal from the metal foam.

In yet another embodiment, the activating comprises increasing the temperature and/or pressure of the metal foam powder.

In yet another embodiment, the temperature is 200 to 650° C.

In yet another embodiment, the increasing the temperature is facilitated by an induction coil located at an extruder die and lies inside the conduit during the extrusion.

In yet another embodiment, the increasing the pressure is accomplished by a ram that enters the conduit and travels opposite to the direction of travel of the extrudate.

In yet another embodiment, the metal conduit and the metal foam comprises aluminum.

In an embodiment, a device for producing a foamed metal comprises an extruder that comprises one or more screws for extruding a metal through a die to form a conduit. The die comprises a plurality of ports for injecting a metal foam powder into a central hollow cavity or a wall cavity of the conduit. The device comprises a pressurizing section for increasing pressure on the metal foam powder and a thermal section for increasing the temperature of the metal foam powder to facilitate its expansion into a metal foam.

In an embodiment, the pressurizing section comprises a roll mill or a ram that travels in an opposite direction from the extrudate.

In yet another embodiment, the thermal section comprises a convection oven or an induction coil.

In yet another embodiment, the induction coil is proximate to the die.

In one embodiment, an article comprises a conduit comprising a first metal. The conduit comprises one or more cavities. At least one cavity contains a metal foam. The conduit wall surrounds the metal foam. The metal foam comprises a second metal.

In an embodiment, the first metal is the same as the second metal.

In yet another embodiment, the first metal and the second metal is aluminum.

In yet another embodiment, the one or more cavities are located between an inner wall and an outer wall of the conduit.

In yet another embodiment, the one or more cavities are located concentrically with respect to a conduit wall.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

The following description is merely exemplary in nature and is not intended to limit the present disclosure, its application or uses.

Disclosed herein is a method of manufacturing metal foams that are encompassed by a metal skin. The metal skin preferably forms a wall around the foam and encapsulates the foam. In an embodiment, the metal skin is a conduit wall that contains a foam; the foam being located in a central hollow cavity of the conduit. In another embodiment, the foam can be contained in a hollow cavity in the conduit wall (hereinafter a "wall cavity"). In another embodiment, the foam may be located in the central hollow cavity of the conduit, in a wall cavity and in both the central hollow cavity as well as in the wall cavity. The metal foam has a density that is 3% to 15% the density of the unfoamed metal and may or may not have the same metal composition as that of the conduit wall.

The method comprises extruding a conduit with one or more hollow cavities that contains the foam. Both the extrusion of the conduit and the foaming of the metal in the cavity take place simultaneously. The foaming takes place by injecting a metal foam powder into one or more hollow cavities of the conduit and activating the metal foam powder by using a combination of heat and pressure.

Figure 1:
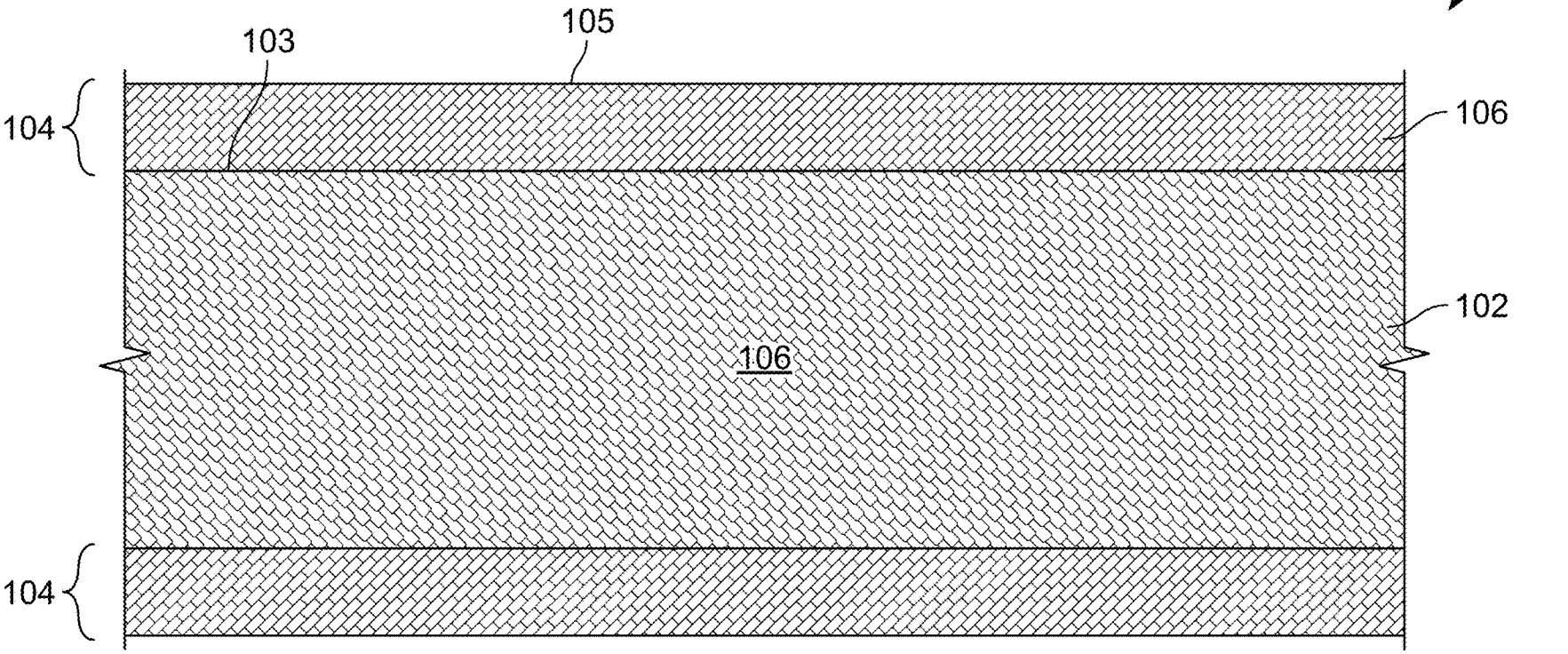
FIG. 1 is an exemplary depiction of a conduit that has its cavities filled with a metal foam.

FIG. 1 depicts an exemplary conduit 100 comprising a foam 106 located in the central hollow cavity 102 as well as in a wall cavity 104 of the conduit 100. The conduit may have a cross-sectional area whose geometry is circular, ellipsoidal, square, triangular, rectangular, polygonal, or a combination thereof. It may also have an irregular cross-sectional area geometry if desired. While the FIG. 1 depicts the foam as being disposed in the central hollow cavity 102 as well as in the wall cavity 104, it is to be noted that the foam may be located in one or more of these locations as desired. The central hollow cavity 102 is concentrically located with respect to the conduit wall(s). The central hollow cavity 102 may also be eccentrically located with respect to the conduit wall(s). The conduit is preferably manufactured from a first metal while the foam is manufactured from a second metal. The first metal may be the same or different from the second metal. In a preferred embodiment, the first metal is the same as the second metal.

When the first metal is different from the second metal, it is desirable for the first metal (that forms the conduit walls) to have a higher melting point than the melting point of the second metal (that forms the foam).

With reference now again to the FIG. 1, conduit 100 may be split into an inner wall 103 and an outer wall 105 and the wall cavity 104 in between the inner and outer wall may be filled with a foam 106. The splitting of the conduit 100 will be discussed in detail later. It is to be noted that the foam 106 in the central hollow cavity 102 may be the same or different from the foam in the wall cavity 104. For example, the central hollow cavity 102 may contain a first metal foam that is different from a second metal foam contained in the wall cavity 104.

In another embodiment, the conduit 100 may be split into a plurality (2 or more walls) of walls some of which or all of which can be filled with a metal foam. For example, the conduit may be split into an inner wall, an outer wall and 2 to 5 intermediate walls (the intermediate walls being located between the inner and outer walls) with the cavities therebetween being filled with a metal foams if desired.

In one embodiment, the foamed first metal and/or the foamed second metal may contain an additional foamed polymer. The average pore size of the polymeric foam is preferably smaller than the average pore size of the metal foam. The presence of a foamed polymer in the foamed metal improves impact absorption capabilities of any part manufactured from the metal foam.

The first metal and the second metal include transition metals or alloys comprising transition metals. The metals referred to herein are preferably in their elemental form. Examples of a suitable first metal and/or second metal include iron, aluminum, copper, titanium, tungsten, nickel, cobalt, tin, lead, silicon, magnesium, manganese, vanadium, molybdenum, gallium, indium, thallium, gold, silver, or the like, or a combination thereof. In an embodiment, aluminum is a preferred first metal. In another embodiment, aluminum is also a preferred second metal.

Alloys may also be extruded into a conduit that contains the metal foam. Suitable alloys are stainless steel, carbon steel, titanium-aluminum alloys, ferroalloys, ferroboron, ferrochrome (chromium), ferromagnesium, ferromanganese, ferromolybdenum, ferronickel, ferrophosphorus, ferrotitanium, ferrovanadium, ferrosilicon, Al—Li (aluminum, lithium, sometimes mercury), Alnico (aluminum, nickel, copper), Duralumin (copper, aluminum), Magnalium (aluminum, 5% magnesium), Magnox (magnesium oxide, aluminum), Nambe (aluminum plus seven other unspecified metals), Silumin (aluminum, silicon), Billon (copper, silver), Brass (copper, zinc), Calamine brass (copper, zinc), Chinese silver (copper, zinc), Dutch metal (copper, zinc), Gilding metal (copper, zinc), Muntz metal (copper, zinc), Pinchbeck (copper, zinc), Prince's metal (copper, zinc), Tombac (copper, zinc), Bronze (copper, tin, aluminum, or any other element), Alumel (nickel, manganese, aluminum, silicon), Chromel (nickel, chromium), Cupronickel (nickel, bronze, copper), German silver (nickel, copper, zinc), Hastelloy (nickel, molybdenum, chromium, sometimes tungsten), Inconel (nickel, chromium, iron), Monel metal (copper, nickel, iron, manganese), Mu-metal (nickel, iron), Ni—C (nickel, carbon), Nichrome (chromium, iron, nickel), Nicrosil (nickel, chromium, silicon, magnesium), Nisil (nickel, silicon), Nitinol (nickel, titanium, shape memory alloy), or the like, or a combination thereof.

A preferred metal for the conduit 100 and for the foam 106 contained therein is aluminum.

The metal foam can comprise open cells, closed cells, or a combination thereof. In an embodiment, the metal foam can comprise 5 to 95, preferably 20 to 80 volume percent of open cells, with the remainder being closed cells.

The metal foam preferably comprises a plurality of open cells. The foam also have some closed cells disposed in between the open cells. However, the majority of cells in the metal foam are open cells. The open cell foams provide higher energy absorption characteristics to the foam for a given density.

In an embodiment, at least 80% of the cells are open cells, preferably at least 90% of the cells are open cells, and more preferably at least 95% of the cells are open cells. The metal foam has an average pore size of 0.5 micrometers to 10 millimeters, preferably 50 micrometers to 5 millimeters, and more preferably 100 micrometers to 2 millimeters. The metal foam has a volumetric porosity of 50 to 95 volume percent, preferably 70 to 90 volume percent, based on the total volume of the metal foam.

Preferred aluminum foams have densities of 0.069 to 0.54 $g/cm^3$, average pore sizes from 25 μm down to 3 μm, and wall thicknesses from 50 to 85 μm. The average cell size is inversely related both to the average cell wall thickness and to the density.

The metal foam 106 is manufactured from a metal foam powder. The metal foam powder may comprise a) a metal powder with a foaming agent, and/or b) metallic hollow spheres that contain an organic sphere with a metal powder-binder suspension disposed thereon. Each of these are detailed below.

Metal foams are obtained by adding a foaming agent to a molten metal when the viscosity of the melt is appropriately established. The foaming agent is usually a powder of metal hydride such as $TiH_2$, which decomposed forming hydrogen when heated to a temperature above 400° C. Other metal hydrides such as, for example, zirconium and magnesium hydrides, which have decomposition temperatures between 280 and 600° C. may also be used as foaming agents.

As the foaming agent comes into contact with the molten metal, the latter instantly decomposes so that there is insufficient time to accomplish a homogeneous distribution of the gas-forming particles.

Non-ferrous foams use conventional foaming agents and metal powders. Commercially available powders (such as aluminum, zinc, tin, or lead) are mixed with the foaming agent by conventional means, such as a drum-type mixer. Subsequent to mixing, the powder blend is compacted to give a dense, virtually non-porous body. Several compaction methods can be employed such as uniaxial pressing, powder extrusion and even roll compaction. When this compact is heated to a temperature around the melting point, it expands into a highly porous cellular body. Various foaming agents have been shown to yield good results for this purpose.

Among the foaming agents used are metal hydrides such as titanium, zirconium and magnesium hydrides, which have decomposition temperatures between 280 and 600° C.

Metallic hollow sphere (MHS) foam structures provide a new kind of foamed metal. This technique ensures the controlled manufacture of single cells to single MHS and reproducible structure of the tailored components. Electrodeposition of various metals such as nickel, cobalt and copper on spherical substrates is first conducted.

An organic sphere substrate, mostly foamed polystyrene, is used as a cell-forming undercoat. A metal powder-binder suspension is atomized onto the outside of the organic sphere substrate. A heat treatment process produces a metal foam while the binder and the organic sphere substrates are removed by a subsequent heat treatment. There are several options to consolidate the single hollow spheres to a MHS component, including sintering, brazing and adhesive bonding.

The metal foam powder is injected into the appropriate cavity during the extrusion process and is converted to a metal foam via the use of an appropriate elevated temperature and pressure.

Figure 2:
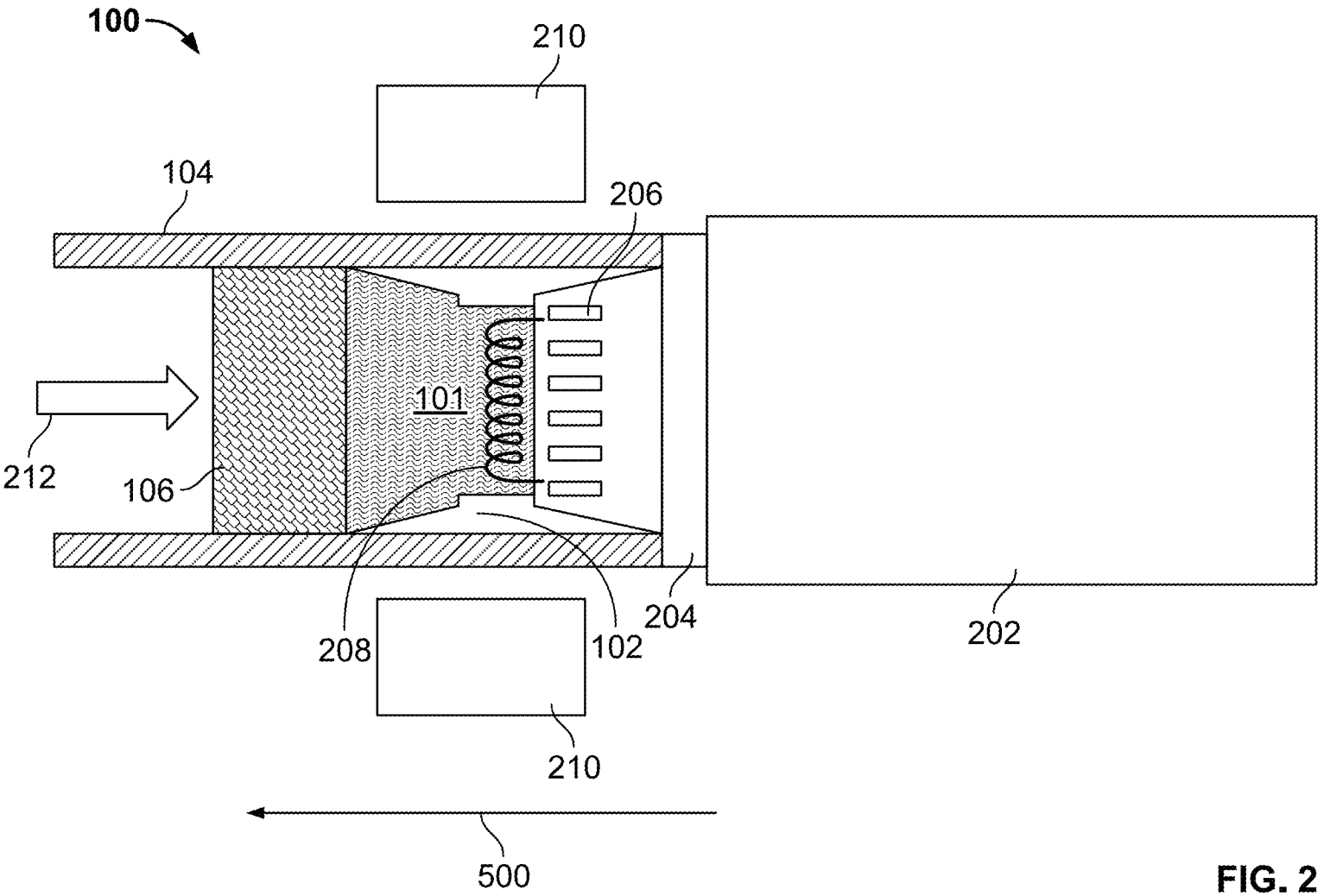
FIG. 2 depicts an exemplary process for producing a conduit whose central hollow cavity is filled with a metal foam.
Figure 3:
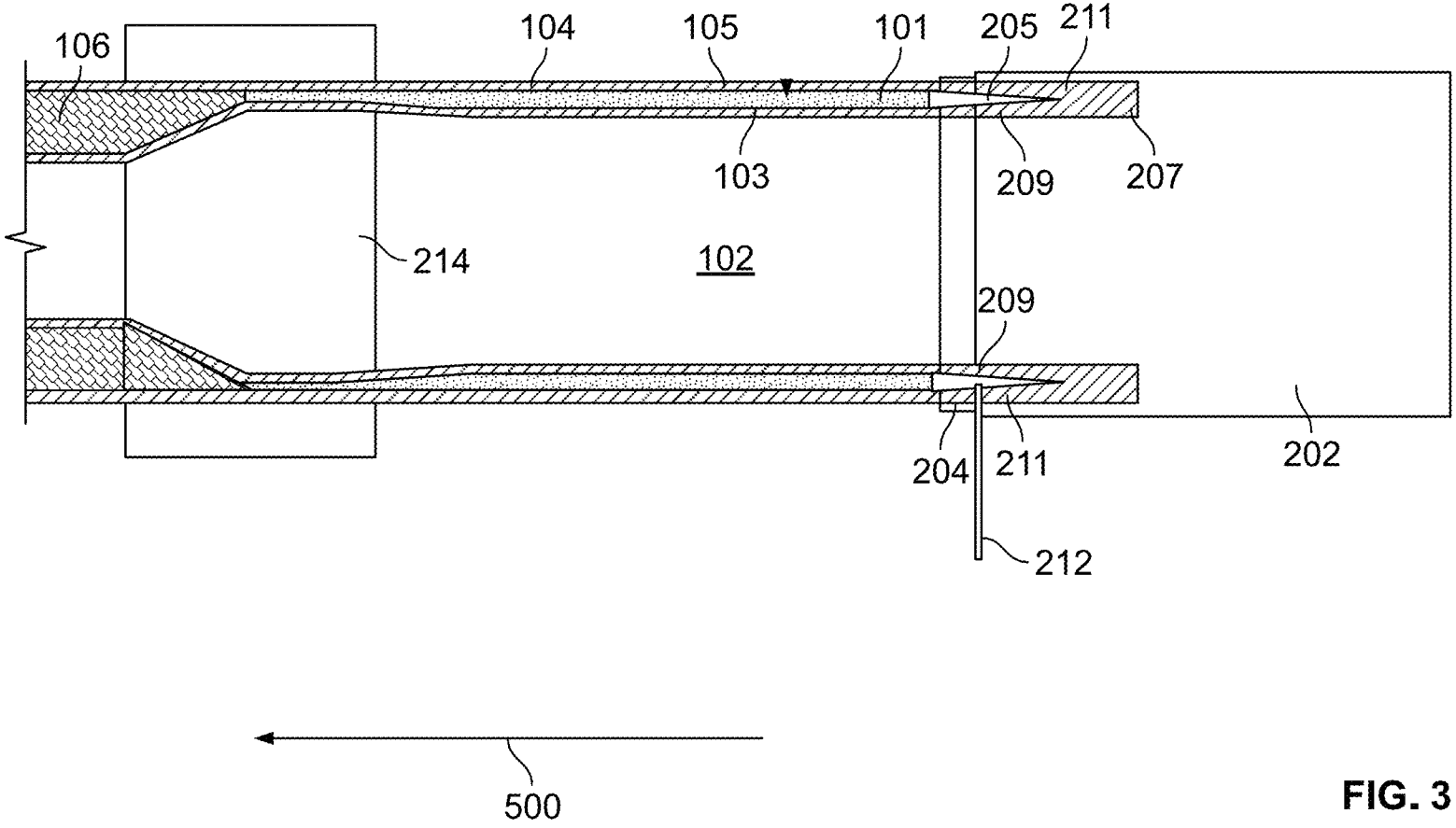
FIG. 3 depicts another exemplary process for producing a conduit whose wall cavity is filled with a metal foam.

Exemplary processes for manufacturing the metal foam in a conduit are depicted in the FIGS. 2 and 3. FIG. 2 depicts an exemplary process for producing a conduit 100 whose central hollow cavity 102 (bounded by conduit wall 104) is filled with metal foam 106 using an extruder 202. The extruder has a die 204 attached thereto, which facilitates the extrusion of the conduit 100. The direction of travel of the extrudate 500 is from right to left (to a viewer facing the paper) as shown by the arrow. The die 204 contains ports 206 through which metal foam powder 101 can be fed into the interior 102 of the conduit 100. The die 204 can also be provided with a separate heating device, such as, for example an induction coil 208 that can heat the metal foam powder 101 to produce the metal foam 106. Alternatively, the extrudate (the conduit 100) can pass through a convection oven 210 which heats the metal foam powder 101 to convert it to the metal foam 106 in the conduit 100. A pressure 212 may be applied on the metal foam powder in the conduit via the open end of the conduit 100 to facilitate the foaming process. For example, a plunger or ram (not shown) may be directed inside the conduit from the open end of the conduit towards the extruder to apply pressure on the metal foam powder to convert it to a metal foam. In other words, the pressure increase on the foam powder is accomplished by a ram that enters the conduit and travels opposite to the direction of travel of the extrudate. The application of an elevated temperature and elevated pressure to the metal foam powder 101 will convert it to a metal foam 106.

The metal foam 106 is produced by heating the metal foam powder 101 to a temperature of 200 to 640° C., preferably 250 to 620° C. and more preferably 300 to 600° C.

A pressure of 20 to 120 kiloPascals, preferably 30 to 100 kiloPascals may be applied to the metal foam powder in the central hollow cavity of the conduit to convert it to a metal foam.

FIG. 3 depicts a process for producing a conduit 100 whose walls have cavities 104 that are filled with the metal foam 106. The process uses an extruder 202 having a die 204 to produce a conduit 100 that has multiple walls 103, 105. The extruder may be a single screw or a multi-screw extruder. The FIG. 3 depicts a die 204 that can produce two walls, an inner wall 103 and an outer wall 105 in the conduit 100. The die 204 contains a splitter 205 that splits an initial stream 207 of molten metal into two streams 209 and 211. The stream 209 forms the inner wall 103 while the stream 211 forms the outer wall 105. A stream of metal foam powder 101 may be injected into the wall cavity 104 through, for example, a port 212 in the splitter 205. The conduit 100 with the metal foam powder 101 contained in the cavity 104 between the inner tube 103 and outer tube 105 is then subjected to an elevated temperature and pressure in a device 214. The device 214 may comprise a roll mill in conjunction with a convection oven. The roll mill may be used to apply pressure on the conduit while the convection oven may be used to raise the temperature of the conduit to activate the metal foam powder thereby facilitating its conversion to a metal foam 106. The metal foam 106 is contained between the inner wall 103 and the outer wall 105. The temperatures and pressures for foaming the metal foam powder 101 within the wall cavity are the same as those detailed above.

In an embodiment (not shown), a metal foam may be generated in the central hollow cavity 102 as well as in the wall cavity 104 simultaneously. In other words, the embodiment detailed in the FIG. 2 may be combined with the embodiment detailed in the FIG. 3. It is to be noted that while the processes in the FIGS. 2 and 3 are continuous processes, the foamed metal parts can also be manufactured in a batch process. Continuous processes are preferred because of their lower energy costs and also because of the increased production speed.

From the FIGS. 2 and 3 it may be seen that a device for producing the metal foam in a conduit comprises an extruder, a device or section for increasing pressure on the metal foam powder and a thermal section for increasing the temperature on the metal foam powder. The extruder comprises one or more screws for extruding a metal through a die to form the conduit.

The die comprises a one or more ports for injecting a metal foam powder into a central hollow cavity or a wall cavity of the conduit. In an embodiment, the die comprises a plurality of ports for injecting the metal foam powder into a central hollow cavity or a wall cavity of the conduit.

The pressurizing section increases pressure on the metal foam powder. The pressurizing section comprises a ram or plunger that travels in a direction opposite to the direction of travel of the extrudate 500. In an embodiment, the pressurizing section can comprise a roll mill. The thermal section increases the temperature of the metal foam powder to facilitate its expansion into a metal foam. The thermal section comprises a convection oven or a induction coil. The induction coil is located on the die or it proximate to the die (of the extruder).

In one embodiment, the metal foam powder may be mixed with a expandable polymer powder (e.g., EXPANCEL) to produce a metal foam that is interspersed with a polymer foam. The combination of a metal foam with a polymer foam will impart improved impact properties and sound absorption capabilities to the foamed part.

Examples of polymeric foams include polystyrene, polyurethane, polyacrylate, polycarbonate, polyolefins, or the like, or a combination thereof.

The metal foams produced in the manner detailed herein have a number of advantages. They can be continuously manufactured in a one step process thereby reducing manufacturing costs. The aluminum foam could be created only on certain walls of the conduit to fine tune performance. The use of metal foam (e.g., aluminum foam) would allow for product design that can take advantage of higher wall stiffness without significant mass increase by using a metal foam in strategic areas for energy attenuation.

Articles manufactured in the manner described herein may be used in vehicles such as automobiles, bicycles and motorcyles, aircraft, locomotives, ships and other sea-going vessels.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A device for producing a foamed metal comprising:

a die;

an extruder comprising:

one or more screws for extruding a metal through the die to form a conduit;

where the die comprises a plurality of ports for injecting a metal foam powder into a central hollow cavity or a wall cavity of the conduit;

a pressurizing section downstream from the die and configured to provide pressure within the central hollow cavity or the wall cavity of the conduit for increasing a pressure on the metal foam powder; and, optionally, a thermal section for increasing a temperature of the metal foam powder to facilitate its expansion into a metal foam.

2. The device of claim 1, where the pressurizing section comprises a roll mill or a ram that travels in an opposite direction from the extruded metal conduit.

3. The device of claim 1, comprising the thermal section where the thermal section comprises a convection oven or an induction coil.

4. The device of claim 3, wherein the induction coil is proximate to the die.

5. A method of forming a metal conduit having a metal foam in a cavity using the device of claim 1 comprising:

extruding the metal conduit having the cavity;

injecting a metal foam powder into the cavity of the metal conduit; and activating the metal foam powder by applying pressure on the metal foam powder in the cavity, and optionally increasing temperature of the metal foam powder, to form the metal foam in the cavity of the metal conduit.

6. The method of claim 5, wherein the cavity is a central hollow cavity concentrically located with respect to a conduit wall.

7. The method of claim 5, wherein the cavity is a central hollow cavity eccentrically located with respect to a conduit wall.

8. The method of claim 5, wherein the cavity is a wall cavity located between an inner wall and an outer wall of the metal conduit.

9. The method of claim 5, wherein the metal conduit and the metal foam comprise the same metal.

10. The method of claim 5, wherein the metal conduit comprises a different metal from the metal foam.

11. The method of claim 5, wherein the activating comprises increasing a temperature of the metal foam powder.

12. The method of claim 11, wherein the temperature is 200 to 650° C.

13. The method of claim 11, wherein the increasing the temperature is facilitated by an induction coil located at an extruder die and lies inside the conduit during the extrusion.

14. The method of claim 5, wherein the increasing the pressure is accomplished by a ram that enters the conduit and travels opposite to the direction of travel of the extruded metal conduit.

15. The method of claim 5, wherein the metal conduit and the metal foam comprise aluminum.

* * * * *